US009433810B2

(12) United States Patent
Willoquet

(10) Patent No.: US 9,433,810 B2
(45) Date of Patent: Sep. 6, 2016

(54) FIRE VALVE

(75) Inventor: Jean-Baptiste Willoquet, Les Avenieres (FR)

(73) Assignee: VRACO SAS, Morestel (FR)

( * ) Notice: Subject to any disclaimer, the term of this patent is extended or adjusted under 35 U.S.C. 154(b) by 1023 days.

(21) Appl. No.: 13/260,776

(22) PCT Filed: Mar. 23, 2010

(86) PCT No.: PCT/FR2010/050520
§ 371 (c)(1),
(2), (4) Date: Nov. 9, 2011

(87) PCT Pub. No.: WO2010/116065
PCT Pub. Date: Oct. 14, 2010

(65) Prior Publication Data

US 2012/0108162 A1 May 3, 2012

(30) Foreign Application Priority Data

Apr. 9, 2009 (FR) ..... 09 52318

(51) Int. Cl.
*A62C 2/12* (2006.01)

(52) U.S. Cl.
CPC ..... *A62C 2/12* (2013.01)

(58) Field of Classification Search
CPC ..... A62C 2/12
USPC ..... 454/369
See application file for complete search history.

(56) References Cited

U.S. PATENT DOCUMENTS 1,100,003 A * 6/1914 Watson ..... F16H 7/18 454/369
2,988,083 A * 6/1961 Lowe ..... 126/285 R
3,327,764 A * 6/1967 McCabe ..... A62C 2/16 160/381
3,336,143 A * 8/1967 Van Dreser et al. ..... 501/122
3,347,569 A * 10/1967 Lindgren ..... F16L 13/002 285/257

(Continued)

FOREIGN PATENT DOCUMENTS

BE 890275 A1 * 3/1982
CN 201036669 Y * 3/2008

(Continued)

OTHER PUBLICATIONS

Schmidt, FR2386752 A1 English machine translation Nov. 3, 1978.*

(Continued)

*Primary Examiner* — Alissa Tompkins
*Assistant Examiner* — Phillip E Decker
(74) *Attorney, Agent, or Firm* — Faegre Baker Daniels LLP

(57) ABSTRACT

The invention relates to a fire valve made of a body (100) consisting of a frame (50) and a tunnel (10) in which a butterfly damper (200) is pivotably mounted between a closed position, separating an inner side (I) from an outer side (E), and an open holding position. The body (100) and the butterfly damper (200) formed by a blade (210) are each produced by assembling cut and pasted refractory sand-lime plates (11, 51, 211). The assembly forming the body (100) and that forming the butterfly damper (200) are provided with steel reinforcements directly attached to the plate assemblies. The reinforcements (60, 70) of the body (100) are attached onto the outer side of the tunnel (10) and of the frame (50) and the reinforcements (240, 250) of the butterfly damper (200) are attached onto both sides of the blade (210). The butterfly damper is locked by the expansion of the metal elements.

11 Claims, 5 Drawing Sheets

(56) References Cited

U.S. PATENT DOCUMENTS 4,084,744 A * 4/1978 Wilson, Jr. ..... A62C 2/12 454/369
4,330,568 A * 5/1982 Boehm et al. ..... 427/452
4,524,678 A * 6/1985 Klebanoff ..... A62C 2/12 454/369
4,579,047 A * 4/1986 Zielinski ..... A62C 2/16 454/369
4,662,288 A * 5/1987 Hastings et al. ..... 109/2
5,005,879 A * 4/1991 Jackson ..... F16L 23/14 285/405
5,103,609 A * 4/1992 Thoreson ..... A62C 2/065 52/232
5,301,475 A * 4/1994 Stefely ..... A62C 2/12 137/360
5,351,448 A * 10/1994 Gohlke ..... A62C 2/065 52/1
5,450,879 A * 9/1995 Toben ..... F24F 13/0209 138/109
5,957,772 A * 9/1999 Rutkowski et al. ..... 454/369
7,018,289 B2 * 3/2006 Heil et al. ..... 454/369
7,082,730 B2 * 8/2006 Monden ..... F16L 5/04 138/161

FOREIGN PATENT DOCUMENTS

EP 0572316 A1 12/1993
FR 2386752 A1 11/1978
FR 2721830 A1 1/1996

OTHER PUBLICATIONS

Constantin, FR2721830 A1 English machine translation, Jan. 5, 1996.*
Constantin, EP0572316 A1 English machine translation, Dec. 1, 1993.*
English translation of the Written Opinion mailed Oct. 9, 2011 in parent International application No. PCT/FR2010/050520.

* cited by examiner

FIRE VALVE

CROSS-REFERENCE TO RELATED APPLICATION

This application is a U.S. National Phase Patent Application based on International Application Serial No. PCT/FR2010/050520 filed Mar. 23, 2010, which is based on French Patent Application No. 0952318 filed Apr. 9, 2009, the disclosures of which are hereby explicitly incorporated by reference herein.

BACKGROUND OF THE INVENTION

1. Field of the Invention

The present invention relates to a fire stop valve which is formed by a member composed of a frame and a tunnel, in which a butterfly damper is mounted for pivoting about an axis between a closed position restoring the fire retardant rating of a wall or a panel and an open position called the standby position.

2. Description of the Related Art

There are many types of fire stop valves which are generally of complex construction in order to be able to withstand the temperatures and pressure differences imposed by some regulations. The complexity of existing valves is made necessary by their structure itself, which transmits the increase of temperature in the chamber to be isolated from the exterior, bringing about expansions, and deformations reducing the fluid-tightness of the valve in the closed position.

SUMMARY OF THE INVENTION

An object of the present invention is to develop a fire stop valve which ensures, for a very long period of time, effective separation between the space to be protected and the exterior whilst using simple means which do not involve prohibitive costs.

To that end, the present invention relates to a fire stop valve of the type defined above, characterised in that the member of the valve and the butterfly damper allow effective thermal insulation between the inner side and the outer side which the valve has to separate in the closed position. That thermal insulation which prevents practically any thermal bridge without thereby weakening the butterfly damper effectively ensures that the interior is cut off and is separated in a sealed manner for a very long period of time under the conditions imposed on such valves.

In spite of the absence of a direct metallic connection between the inner side and the outer side which are separated by the fixed and movable parts of the valve, the valve effectively withstands the pressure difference which must be applied to it.

That structure of the fire stop valve does not complicate its construction, its installation or its actuator.

According to an advantageous feature, the refractory plates are silicocalcareous plates.

According to another advantageous feature, the tunnel is formed by walls which are composed of a plurality of layers of refractory plates which are arranged on edge and the tunnel is mounted on the frame formed by the combination of adhesively bonded plates in a flat state, and the frame carries an abutment belt having an L-like cross-section, of which one branch is fixed in a flat state, at the outer side, to the frame and the other branch surrounds the tunnel, the valve being fixed around the opening to be protected by means of bolts which adjoin the abutment belt. That allows the member of the valve to be constructed, that is to say, the tunnel and the frame thereof, by assembling cut plates which confer on the assembly a stronger, stratified structure than construction from plates having a single thickness. Furthermore, this facilitates the assembly between the tunnel and the frame.

According to another advantageous feature, the tunnel comprises, at the outer side, an external steel frame which is bent into a U-shape and which is fixed to plates carried by the external wall of the tunnel, the external frame having extensions in the form of limbs which are received in openings of the plates. That construction allows the expansile portions to be disengaged from the portions having a small expansion coefficient, that is to say, the portions of the valve constructed from refractory plates, in particular from silicocalcareous plates.

According to another advantageous feature, the butterfly damper is in the form of a panel composed of the assembly of refractory plates, the assembly carrying two axial elements which are received in bearings of the tunnel, the two faces of the panel are reinforced by corner members which are perpendicular to the pivot axis and the two faces of the panel are reinforced in the region of the pivot axis by two bands which receive the plates of the panel in a sandwich-like manner and are fixed to the axial elements by bolts which extend from one side to the other through the assembly which is formed by the first band, the plates, the axial element and the second band. That construction of the butterfly damper affords the advantages of a thermal cutoff whilst having sufficient strength to withstand the pressure difference applied between the two faces of the valve.

According to a particularly advantageous feature, the corner members reinforcing the two faces of the panel of the butterfly damper are mounted by means of screws in oblong holes of the corner members on the faces of the panel in order to allow them to freely expand and in the region of the position of the ends of the corner members, the butterfly damper being closed, the interior of the tunnel is provided with latching plates which receive the end of the corner members when the corner members are extended by the expansion brought about by a temperature increase. That construction effectively joins the butterfly damper to the member of the valve, in the closed position, that is to say, in the active position, without any motor-driven mechanism in order to ensure that locking in a closed position because the locking is carried out by the expansion of the corner members which necessarily occurs, at least at the side exposed to the fire.

According to another advantageous feature, the interior of the tunnel is provided, at the inner side of the valve, with an upper seat and, at the outer side, with a lower seat, against which the panel of the butterfly damper moves into abutment in the closed position, those abutment actions being complemented by left and right, upper and lower half-seats. Those abutments, which are simple to construct, simultaneously ensure thermal insulation, with the creation of thermal bridges being prevented, and the reinforcement of the closed position of the valve.

According to another advantageous feature, one of the axial elements is connected to an actuator fixed to a bearing.

In order to ensure the sealing between the wall of the tunnel and the panel of the closure member 210, an axial washer of silicocalcareous material is fitted on the damper on each of the axial elements in order to receive, in a groove, the thickness of the closure member and to be repelled towards the inner wall of the tunnel by compression springs which are received in the closure member.

According to another advantageous feature, the butterfly damper is in the form of a panel which is composed of the assembly of refractory plates, the assembly carrying two axial elements which are received in the bearings of the tunnel, the bearings are each formed by a plate which is provided with a clip which is coaxial relative to the axis of the damper in order to abut the outer face of the tunnel, the clip being received in a chamber of the tunnel and the clip receives a graphite ring which is retained by a seal-carrying ring, the assembly being capped externally by a planar joint which is covered by a closure plate or by the casing of the actuator.

According to another advantageous feature, the abutment belt is formed by corner members which have L-shaped cross-sections and which are mechanically imbricated in the region of the corners in order to allow them to expand freely.

BRIEF DESCRIPTION OF THE DRAWINGS

The present invention will be described below in greater detail with reference to one embodiment of a fire stop valve illustrated in the appended drawings, in which.

DETAILED DESCRIPTION

Figure 1:
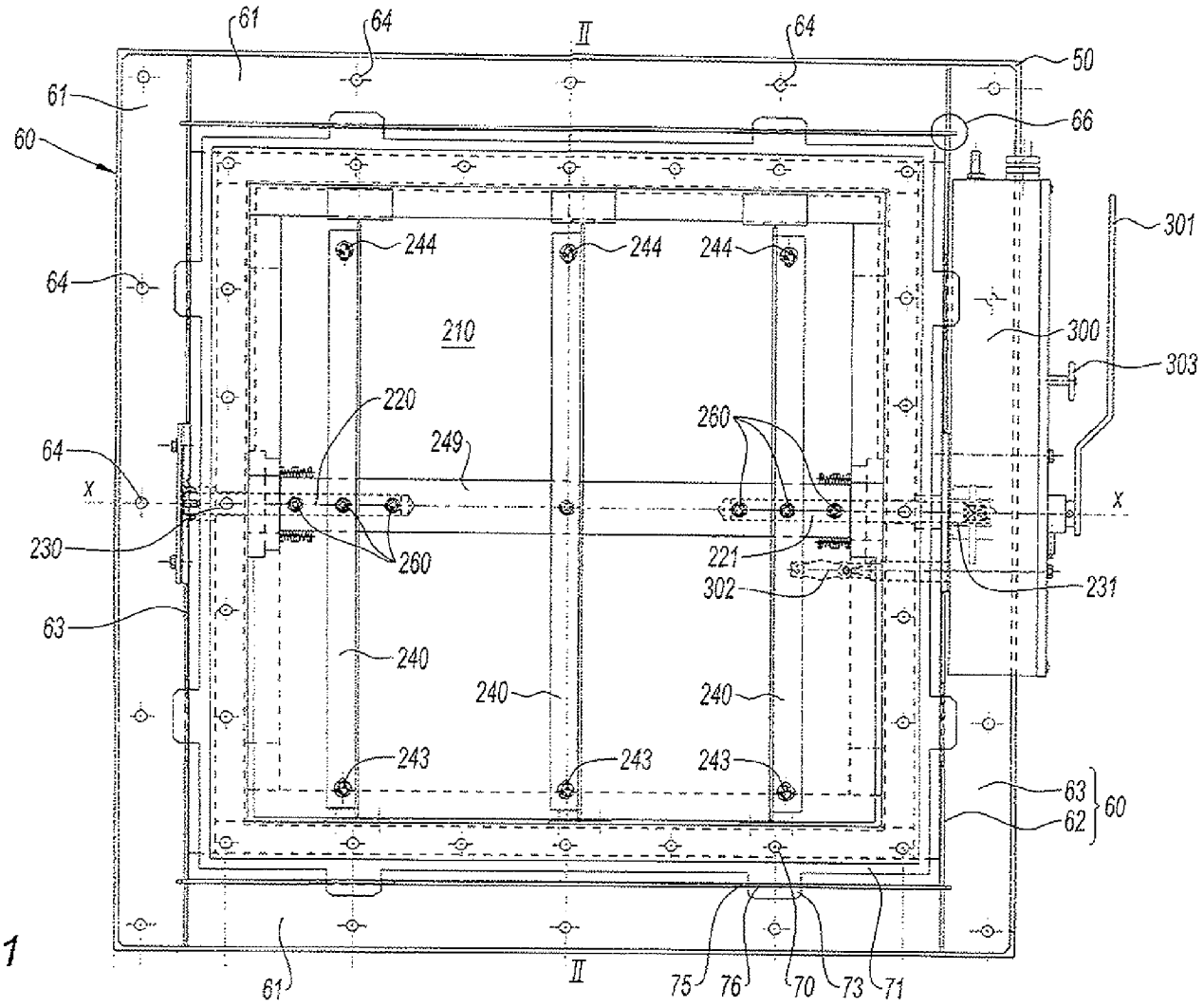
FIG. 1 is a top view of the outer side of the fire stop valve according to the invention.
Figure 2:
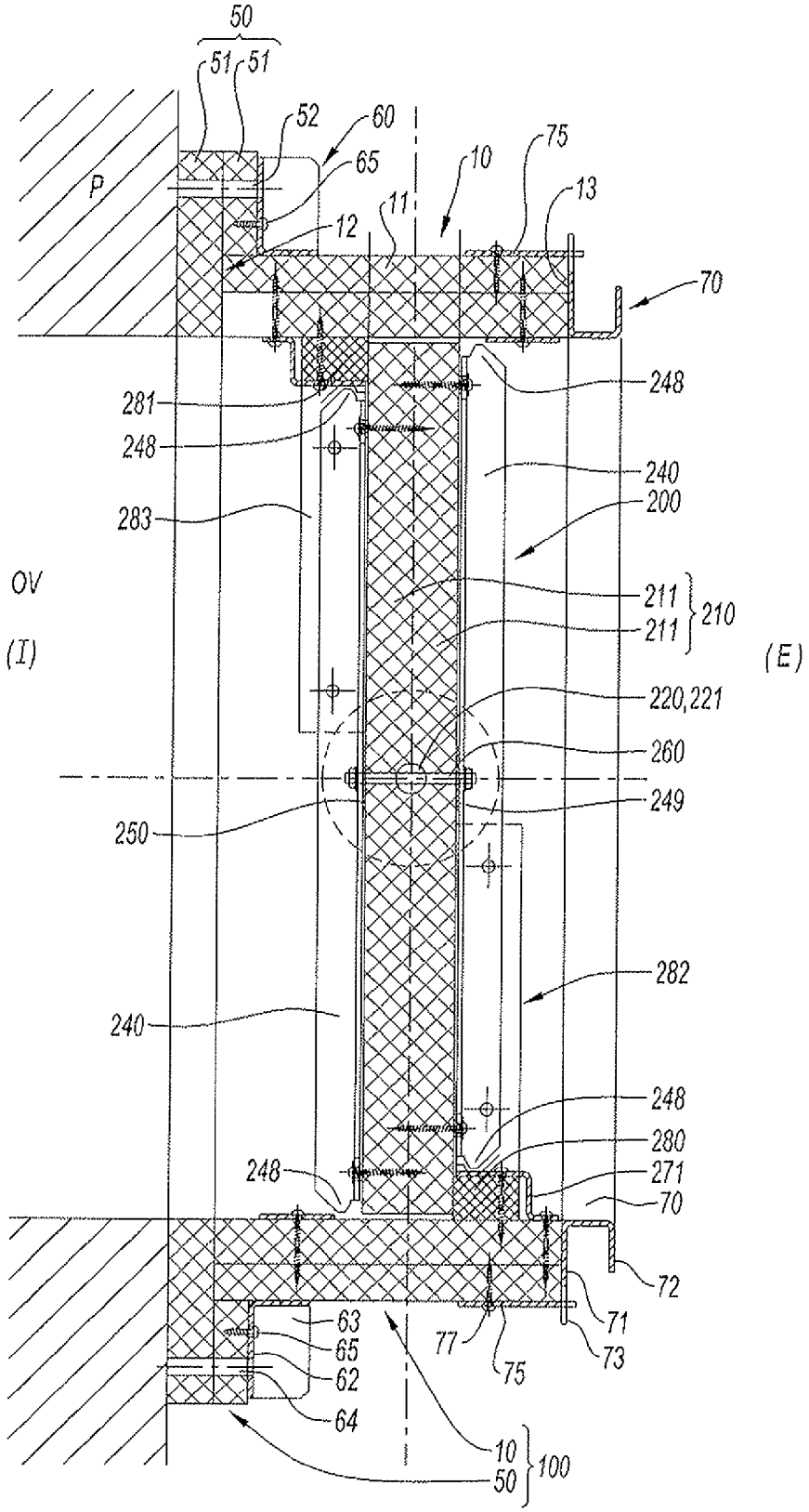
FIG. 2 is a cross-section according to plane 11-11 of FIG. 1.

According to FIGS. 1 and 2, the invention relates to a fire stop valve which is formed by a member 100 composed of a frame 50 and a tunnel 10, in which a butterfly damper 200 is mounted. The butterfly damper 200 is carried by two axial elements about a pivot axis (xx) which is generally horizontal when the valve is installed. The valve is controlled by an actuator 300 which ensures its closure movement; it is combined with a rearming lever 301 and optionally with a closure security member 302 which allows the valve to be closed in the event of detection of an excessive temperature increase, in the region of the valve, and independently of a signal sent by the central control unit to the actuator 300. A manual control unit 303 allows closure tests to be carried out. Rearming is carried out by means of the lever 301.

The butterfly damper 200 of the valve is actuated by the return torque of a spring or an equivalent element of the actuator 300. That return torque is released by the actuator 300, the security device 302 or the manual control unit 303.

According to FIG. 2, the member 100 and the butterfly damper 200 are constructed by assemblies of plates of a refractory material, in particular silicocalcareous plates which are composed of a mixture of silica and calcium carbonate, which has the advantage of being refractory. Those plates are cut and adhesively bonded to each other by an adhesive which is also refractory; the member 100 of the valve and its butterfly damper 200 are provided with reinforcements of sheet steel, which may be flat or bent and which are located at the outer side for the member 100 and on the two faces of the butterfly damper 200.

It will conventionally be understood in the description that the inner side (I) is the side of the valve exposed to heat and the outer side (E) is the side located at the other side of the valve, which side must be separated in a sealed manner by the fire stop valve with respect to the inner side.

In greater detail according to FIGS. 1 and 2, the member of the valve 100 is composed of the tunnel 10 and the frame 50. The peripheral wall of the tunnel 10, which delimits a rectangular or square opening (OV), is formed by the assembly of silicocalcareous plates 11 which are adhesively bonded to each other in the flat state, for example, two layers of plates 11. The tunnel 10 is carried by the frame 50 which is also composed of silicocalcareous plates 51 which are cut, adhesively bonded to each other in the flat state and also adhesively bonded at the inner edge 12 of the tunnel 10. The frame 50 is intended to be pressed against the wall P which bounds the opening OV which is intended to be closed by the fire stop valve.

The assembly of the tunnel 10 and the frame 50 is reinforced by an abutment belt 60 which is constituted by the assembly of four corner members 61 having an L-shaped cross-section, of which one branch 62 is fixed in the flat state against the abutment frame 50 and the other branch 63 is pressed against the outer face of the tunnel 10. The branch 62 pressed against the frame 50 is fixed thereto by retention screws 65 which extend only slightly into the thickness of the plates 51 of the frame without extending therethrough.

Openings 52 and bolt-holes 64 are provided in the frame 50 and in the abutment belt 60 in order to bolt the member 100 of the valve to threaded rods which are carried by the wall P. Those rods are not illustrated.

As shown by FIG. 1, the abutment belt 60 is composed of four corner members 61 which are connected at the corners 66 (one of the zones is surrounded by a circle) without being fixedly joined to each other so as to allow free expansion play of those four corner members 61 under the effect of a temperature increase in order to keep the fire stop valve sealed for the time fixed by provisions.

Figure 3:
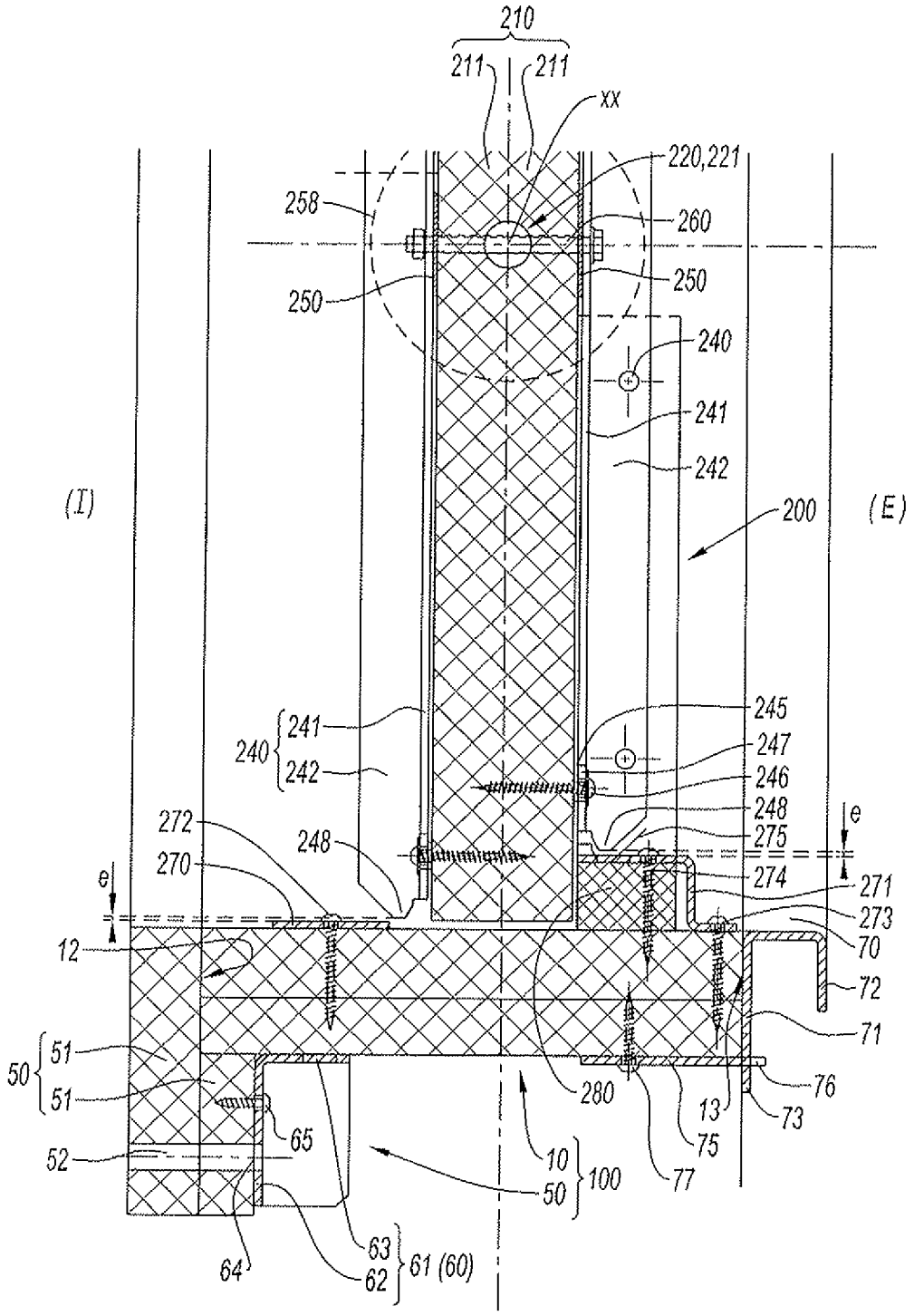
FIG. 3 is the sectional view of FIG. 2 drawn to an enlarged scale.

According to FIGS. 2 and 3, the outer edge 13 of the tunnel 10 is bounded by an outer steel frame 70 which is formed by a metal profile-member which is bent into a U-shape, of which one branch 71 is pressed against the edge 13 of the tunnel and the other branch 72 is free.

The assembly between the outer frame 70 and the tunnel 10 is brought about by means of limbs 73 which are carried by the branch 71 of the frame. Those limbs 73 protrude towards the outer side of the contour of the frame 70 in order to freely engage in the direction of expansion in oblong openings 76 which are constructed in plates 75 which are connected by screws 77 against the outer wall of the tunnel 10.

The butterfly damper 200 is formed by a panel 210 which is composed of silicocalcareous plates 211. That panel 210 or more generally the butterfly damper 200 is mounted for pivoting about the geometric axis (xx) which is defined in the plane of FIG. 1 and which is perpendicular to the plane of FIG. 2.

According to the geometric axis (xx), the panel 210 carries two axial elements 220, 221 which are received in bearings 230, 231 which are fixed to the tunnel 10 which forms the frame of the butterfly damper 200.

The axial element 221 cooperates with the actuator 300 which is fixed to the side of the tunnel and is connected by nesting and form-fitting connection.

The outer face and the inner face of the panel 210 are reinforced by corner members 240 which have an L-shaped cross-section and which are fixed by a branch 241 in the flat state against each of the two faces of the panel 210. That fixing is carried out by interposing on each face a band 249 which is aligned in accordance with the pivot axis (xx). The excess thickness brought about by the band 249 is compensated for at the other two fixing locations 243, 244 of each reinforcement corner member 240 by a washer 245 having the same thickness as the bands 249 (FIG. 3). Furthermore, in the region of the two fixing locations 243, 244, each corner member 240 is fixed to the panel 210 by a screw 246 which extends through an oblong hole 247 and also the washer 245 forming the thickness spacer.

The assembly of the panel 210 of the butterfly damper and the axial elements 220, 221 thereof is carried out by means of bolts 260 which extend through the bands 249, the thickness of a plate 211, the axial element 220, 221 in order to extend back through the other plate 211 and the other band 249. Some bolts 260 also extend through the two corner members 240 at one side and the other of the panel 210.

According to the view of FIGS. 2 and 3, the ends of the branches 242 of the corner members 240 which are perpendicular to the surface of the plate 210 have projections 248 which are intended to cooperate with latches 270, 271 which are carried by the tunnel 10 at a location opposite the projections 248 when the butterfly damper 200 is in a closed position.

The latch 270 is a steel plate which is screwed by screws 272 against the inner surface of the tunnel 10.

The other latch 271 is a piece of bent sheet metal which is screwed by screws 273 directly against the inner surface of the tunnel 10 and the portion of the latch 271 bent into a perpendicular shape is screwed by screws 274 with a lower/upper seat 280, 281 being interposed for the upper edge and the lower edge of the panel 210.

The seats 280, 281 are complemented by left, right, upper and lower half-seats 282,283.

In a closed position and at ambient temperature, the projections 248 of the corner members 240 are spaced apart by the distance (e) from the latches (270, 271), which allows the projections to pass and the panel 210 to move in a pivoting manner. Under the effect of heat, however, expansion extends the corner members 240 whose projections 248 become engaged, in some cases behind the latches 270 and, in other cases, in openings 275 of the latches 271, which not only prevents the pivoting of the panel 210 in the direction of the opening but also relieves the axial elements 220, 221 and the bearings 230, 231 thereof in respect of the thrust applied to the panel 210 by the pressure difference between the inner side (I) and the outer side (E). The upper and lower locking in the region of the latches 271 ensures securing of the plates 211 of the panel 210 and reinforces their resistance to loads.

Figure 4:
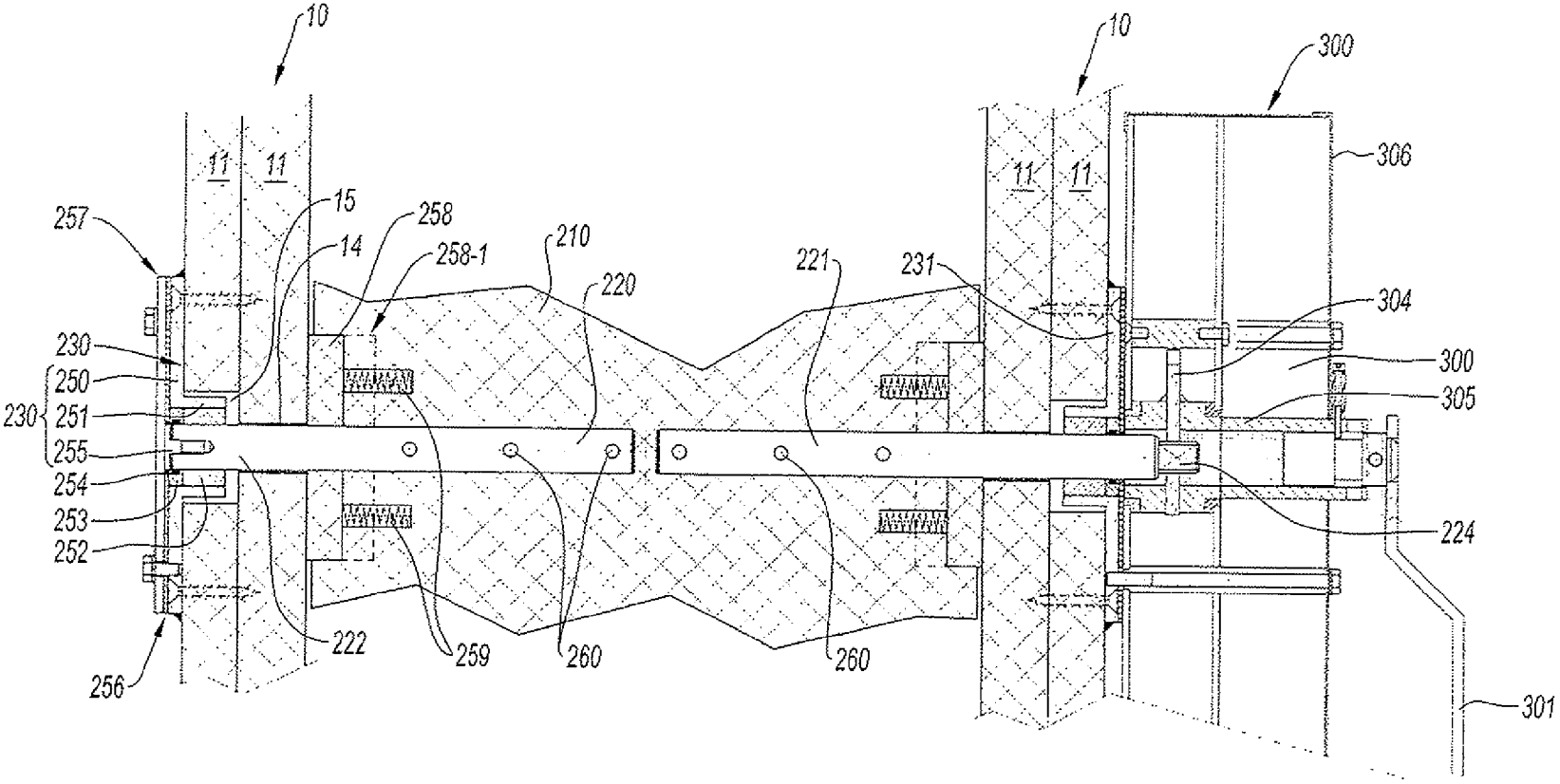
FIG. 4 is an axial section of the two bearings of the damper and FIG. 5 is a sectional view, drawn to an enlarged scale, of a bearing of the butterfly damper (the one not carrying the actuator).
Figure 5:
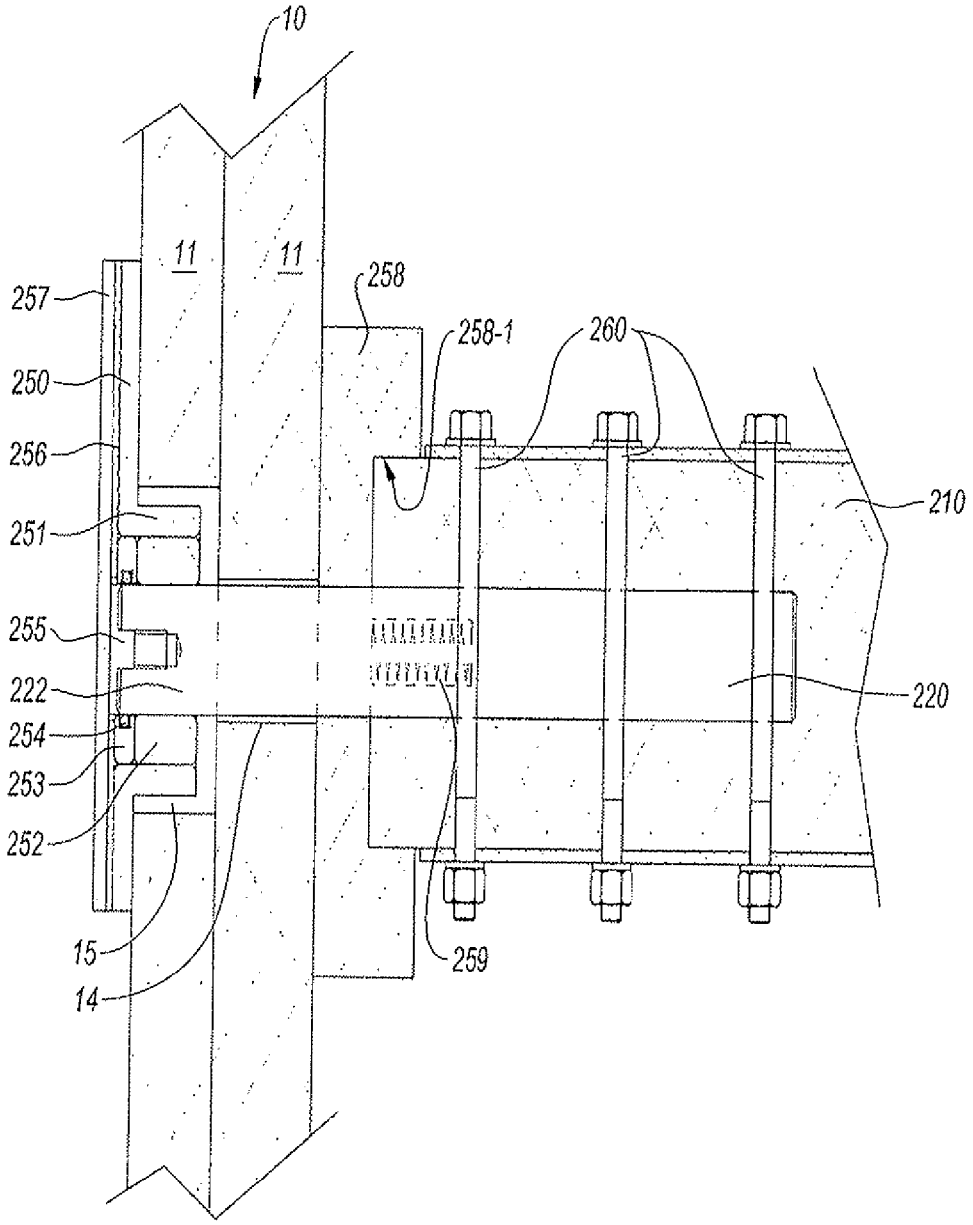

According to FIGS. 4 and 5, since the bearings 230, 231 have an identical structure except that the bearing 231 opens in the actuator 300 and also carries the lever 301, the detailed description of the portions common to the two bearings will be given only for the bearing 230. The same reference numerals refer to the same components for the two bearings.

In that manner, the axial element 220 extends through a hole 14 of the first plate 11 of the tunnel 10 in order to open in the chamber 15 which is formed by the second plate 11 of that tunnel. The bearing 230 is composed of a plate 250 which is fixed against the outer side of the tunnel 10 which is fixedly joined to a clip 251 which is received in the chamber 15. The end 222 of the axial element 220 is provided with a graphite ring 252 which is received in the clip 251 and which is retained by a seal-carrying steel ring 253 which is force-fitted in the clip 251 and which adjoins the end 222 via an O-ring 254. The end 222 is covered by an abutment plug 255.

A planar joint 256 covers the entire plate 250 of the bearing 230 and the assembly is covered by a closure plate 257 which, in the case of the bearing 231, is replaced by the actuator 300.

Inside the tunnel 10, the axial element 220 extends through an axial washer 258 composed of a silicocalcareous material. The washer 258 comprises a groove 258-1 (cross-section in FIG. 5), in which the thickness of the panel of the closure member 210 is fitted.

This axial washer 258 is repelled towards the inner wall of the tunnel 10 by two compression springs 259 which are received in the closure member 210 which prevents a gap from being able to generate a leak between the two faces of the closure member 210 whilst allowing it to rotate freely.

The ring 252, which serves to ensure the guiding of the axial elements 220 and 221, is composed of graphite. That material has been selected for its self-lubricating qualities and its excellent resistance at high temperatures.

The ring 252 which carries the O-ring and the planar joint 256 which covers the entire outer face of the bearing 30 allow the sealing between the interior of the tunnel 10 and the exterior to be ensured.

The bearing 231 differs from the bearing 230 owing to the end 224 of the square axial element 221 which is blocked in terms of rotation by form-fitting connection in the opening of an arm 304 which is carried by the actuator and which is fixedly joined to the rotary sleeve 305 which extends out of the casing 306 of the actuator and which carries the operating lever 301.

LIST OF REFERENCE NUMERALS

10 Tunnel
11 Plate of tunnel
12 Inner edge of tunnel
13 Outer edge of tunnel
14 Hole
15 Chamber
50 Frame
51 Plates of frame
52 Openings
60 Abutment belt
61 Corner member of abutment belt 60
62 Branch of corner member 61
63 Branch of corner member 61
64 Openings
65 Screws
66 Corners of abutment belt
70 Outer frame
71, 72 Branches of frame 70
73 Limb
75 Plate
76 Oblong opening
77 Screw for fixing plate 75
100 Member of valve
200 Butterfly damper
210 Panel
211 Plates forming panel 210
220,221 Axial elements
222 End
230,231 Bearings
240 Corner member
241, 242 Branches of the corner member
243, 244 Locations for fixing the corner member

245 Washer forming thickness spacer
246 Screw
247 Oblong hole
248 Projection of corner member
249 Band
250 Plate of bearing 230, 231
251 Clip
252 Ring
253 Seal-carrying ring
254 O-ring
255 Abutment plug
256 Planar joint
257 Closure plate
258 Axial washer
258-1 Groove
259 Spring
260 Bolts
270 Latch
271 Latch
272, 273 Screw for fixing latches
274 Screw for fixing latches
275 Openings in latch 271
280, 281 Lower/upper seats
282, 283 Left, right, upper and lower half-seats
300 Actuator
301 Rearming lever
302 Closure security member
303 Manual control unit
304 Arm
305 Sleeve
306 Casing
xx Pivot axis
e Spacing
E Outer side
I Inner side
OV Opening in wall
P Wall

The invention claimed is:

1. A fire stop valve mounted to a wall around an opening in the wall, said fire stop valve comprising:

a member including a frame and a tunnel, said frame and said tunnel each having exterior surfaces, said tunnel further having an interior;

a butterfly damper mounted within said interior of said tunnel, said butterfly damper pivotable about a pivot axis between an open position, and a closed position in which said butterfly damper separates an outer side of said member from an inner side of said member which is directly exposed to heat;

said member and said butterfly damper each formed by an assembly of refractory plates adhesively bonded to one another, said frame including a refractory plate in direct abutment with the wall without any metal component disposed therebetween;

said member and said butterfly damper each provided with steel reinforcements directly fixed to respective said plate assemblies thereof, wherein:

said reinforcements of said member comprise a belt formed of a plurality of separate, elongate members each having an L-shaped cross section with first and second branches, one of said first and second branches respectively fixed to a respective said exterior surface of said frame and the other of said first and second branches in abutment with said tunnel, said elongate members each disposed in their entirety on said outer side of said member with said first and second branches in respective abutment only with said refractory plates of said frame and tunnel of said member, said L-shaped members connected to one another at respective corners without being fixed to one another to thereby allow movement of said L-shaped members with respect to one another to accommodate thermal expansion;

said reinforcements of said butterfly damper fixed to each of two opposite faces of said plate assembly of said butterfly damper; and said interior of said tunnel including a first seat on said inner side of said member and a second seat on said outer side of said member, said plate assembly of said butterfly damper abutting said first and second seats in said closed position, said first and second seats each interposed between an inner surface of said tunnel and a sheet metal component secured by screws against said inner surface of said tunnel; and said tunnel further comprises, at an outer end of said tunnel disposed opposite said frame, an external frame having a U-shaped cross section, said U-shaped cross section opening in a direction perpendicular to an axial extent of said tunnel, said external frame fixed to plates carried by an external wall of said tunnel, said external frame including extensions extending in a direction perpendicular to said axial extent of said tunnel and received in openings of said plates.

2. The fire stop valve of claim 1, wherein said refractory plates are silicocalcareous plates.

3. The fire stop valve of claim 1, wherein said tunnel is formed by a plurality of layers of said refractory plates disposed parallel to said pivot axis, and said frame is formed by a plurality of layers of said refractory plates disposed perpendicular to said pivot axis.

4. The fire stop valve of claim 1, wherein:

said butterfly damper is in the form of a panel including said assembly of refractory plates, said panel having two opposite faces, said assembly further including two axial elements received in respective bearings of said tunnel;

said faces of said panel reinforced by corner members disposed perpendicular to said pivot axis; and said faces of said panel further reinforced in a region of said pivot axis by two bands which receive therebetween said refractory plates of said panel, said bands fixed to said axial elements by bolts, each said bolt extending from one said face of said panel to the other said face of said panel through a first said band, said refractory plates, a said axial element, and a second said band.

5. The fire stop valve of claim 4, wherein said corner members are mounted to said panel by screws extending through oblong holes in said corner members to provide for expansion; and said interior of said tunnel includes latching plates disposed proximate ends of said corner members when said butterfly damper is in said closed position, said latching plates receiving said ends of said corner members when said corner members are extended by expansion resulting from a temperature increase, thereby locking said the butterfly damper in said closed position.

6. The fire stop valve of claim 4, wherein one of said axial elements is connected to an actuator, said actuator fixed to a respective said bearing.

7. The fire stop valve of claim 4, wherein an axial washer of silicocalcareous material is fitted on said butterfly damper around each said axial element between said panel of the butterfly damper and a wall of said tunnel, said washers each received within a groove of said panel of said butterfly damper, each washer biased towards said wall of said tunnel by at least one compression spring received within said groove thereby allowing said butterfly valve to pivot without leaving any gap between said butterfly valve and said tunnel wall.

8. The fire stop valve of claim 1, wherein said elongate members abut one another proximate corners of said belt to allow said elongate members to expand freely.

9. The fire stop valve of claim 1, wherein said butterfly damper is in the form of a panel composed of said assembly of refractory plates, said assembly carrying two axial elements received in respective bearings of said tunnel, said bearings each formed by a plate provided with a clip which is a coaxial relative to said pivot axis of said butterfly damper, said clip received in a chamber of said tunnel and the slip receiving a graphite ring retained by a seal-carrying ring, said bearings being capped externally by a planar joint covered by one of a closure plate and a casing of an actuator.

10. The fire stop valve of claim 1, wherein said first branches of said elongate members are fixed to said exterior surfaces of said frame by screws which extend only partially into a thickness of said plates of said frame.

11. The fire stop valve of claim 1, wherein said tunnel includes an interior end adapted to be mounted to a wall, and an exterior end, and said interior surface of said tunnel lacks any metallic components attached to said interior surface at a location proximate said interior end.

* * * * *